United States Patent [19]

Etheredge et al.

[11] 4,343,416

[45] Aug. 10, 1982

[54] CONTAINER FOR NUCLEAR FUEL POWDERS

[75] Inventors: Benjamin F. Etheredge; Richard I. Larson, both of Wilmington, N.C.

[73] Assignee: General Electric Company, San Jose, Calif.

[21] Appl. No.: 84,135

[22] Filed: Oct. 12, 1979

Related U.S. Application Data

[62] Division of Ser. No. 844,750, Oct. 25, 1977, abandoned.

[51] Int. Cl.[3] ..... B65D 83/06

[52] U.S. Cl. ..... 222/1; 222/165; 222/630; 222/195

[58] Field of Search ..... 222/630, 637, 195, 166, 222/165, 1; 176/46

[56] References Cited

U.S. PATENT DOCUMENTS

| | | | |
|---|---|---|---|
| 2,965,269 | 12/1960 | Knutsen | 222/195 |
| 3,009,607 | 11/1961 | Sayre | 222/195 |
| 3,693,842 | 9/1972 | Cozzarin et al. | 222/195 |
| 3,840,155 | 10/1974 | Frye et al. | 222/195 |
| 3,998,362 | 12/1976 | Lapierre et al. | 222/185 |

FOREIGN PATENT DOCUMENTS

| | | | |
|---|---|---|---|
| 493175 | 5/1950 | Belgium | 222/166 |

OTHER PUBLICATIONS

*Nuclear Safety Guide* 1961; U.S. Atomic Energy Commission.

*Introduction to Nuclear Reactor Theory*; John Lamarsh; Addison-Wesley Publishing Comp. Inc. 1966; Reading, Mass.; Sect. 9-7 & 9-8; pp. 307-310.

*Primary Examiner*—Charles A. Marmor

*Attorney, Agent, or Firm*—Ivor J. James, Jr.; Samuel E. Turner; Raymond G. Simkins

[57] ABSTRACT

A critically safe container for the storage and rapid discharge of enriched nuclear fuel material in powder form is disclosed. The container has a hollow, slab-shaped container body that has one critically safe dimension. A powder inlet is provided on one side wall of the body adjacent to a corner thereof and a powder discharge port is provided at another corner of the body approximately diagonal the powder inlet. Gas plenum for moving the powder during discharge are located along the side walls of the container adjacent the discharge port.

1 Claim, 2 Drawing Figures

CONTAINER FOR NUCLEAR FUEL POWDERS

CROSS REFERENCE TO RELATED APPLICATION

This is a continuation of application Ser. No. 844,750, filed Oct. 25, 1977, and now abandoned.

BACKGROUND OF THE INVENTION

A particulate form (or powder) of enriched nuclear fuel material is handled in various steps in the production of nuclear fuel pellets that are ultimately enclosed in a cladding for use as fuel rods in nuclear reactors. It is necessary to transport the powder from one location to another in a nuclear fuel fabrication facility, e.g., from inventory to a blending facility for admixing with enriched powder or for admixing with additives, and from the blending facility to the pellet presses.

Accordingly, various containers have been proposed for holding nuclear fuel powders to facilitate such transportation. However, problems have been encountered in unloading powder from such containers due to the inherent characteristic of powders to pack (or bridge) in the container and fail to flow in the absence of some applied force.

It is also necessary to have a container that is critically safe for holding enriched nuclear fuel powders. As used herein, "critically safe" means avoiding any nuclear fission of the nuclear fuel powders held in a container.

SUMMARY OF THE INVENTION

The present invention solves the foregoing problems by providing a critically safe container for the storage and rapid discharge of enriched nuclear fuel material in powder form. The container comprises a hollow, slab-shaped container body that has one critically safe dimension designed for holding said fuel material. A powder inlet opening is provided on one side wall of the body adjacent to a corner thereof and a powder discharge port is provided at another corner of said body which is approximately diagonal to the powder inlet opening. Means for moving the powder during discharge are provided and are located along the side walls of the container adjacent the discharge port. The means for moving the powder are comprised of two gas plenums for feeding gas into the container body to reduce the friction between the container surface and the powder held in the container body to facilitate discharge of the powder.

OBJECT OF THE INVENTION

It is an object of this invention to provide a critically safe container for storage of enriched nuclear fuel powders and for readily discharging said powders from said container.

Other objects and advantages of this invention will be readily apparent to a person having ordinary skill in the art from reading the following specification and the appended claims with reference to the accompanying drawings described immediately hereinafter.

DESCRIPTION OF THE INVENTION

Figure 1:
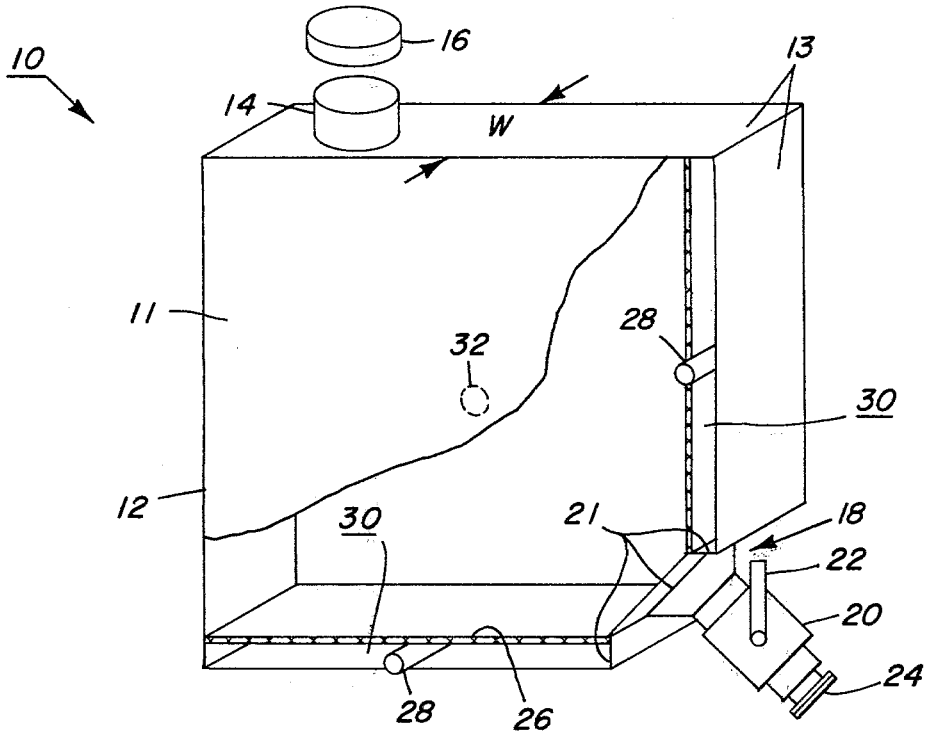
FIG. 1 is a perspective view, partially in section, of the slab-shaped container for nuclear fuel powders of this invention.

Referring now to FIG. 1, there is shown a critically safe container 10 comprising a hollow, slab-shaped container body 12 (i.e., a parallelepiped) having two large planiform walls 11 and four side walls 13 and one dimension (w) that is critically safe for holding a nuclear fuel material that is enriched with fissile material up to about 4% by weight. A powder inlet 14 in the form of a pipe opens on one side wall of said body 12 adjacent to a corner thereof. The inlet is closed by placing airtight cover 16 on inlet (pipe) 14. A powder discharge port 18 opens at another corner of said body 12 which is approximately diagonal to the powder inlet 14. A ball valve 20 operated by valve handle 22 is attached to the discharge port 18, and valve 20 has outlet nozzle 24 from which powder is discharged. In greater detail, the port 18 is formed by cutting away (truncating) the corner of the body 12, as shown by lines 21, and attaching orifice member (truncated cone) 19 prior to connecting valve 20.

Means for moving the powder held in container 10 (i.e., gas plenums) are provided along the side walls of the container adjacent the discharge port 18. The means for moving the powder is comprised of gas inlets 28 that receive a moderate rate of flow of a gas, such as dry, clean nitrogen or air (e.g., from about 1 to 7 cubic feet/minute) and feed the gas into plenums 30 formed by attaching porous metal, rectangular-plate members 26 inside body 12 spaced apart from their adjacent parallel side walls. In practice, the gas flow is limited to the region of the rectangular-plate members 26 and the gas flows out the discharge port 18 with the powder. In effect, the means for moving the powder greatly reduces friction between the powder and the surface (member 26) with which it is in contact.

Mounting means, such as a socket 32 for receiving a peg, is positioned on one of the large planiform walls 11 so that container 10 can be mounted for loading and unloading or powders.

Figure 2:
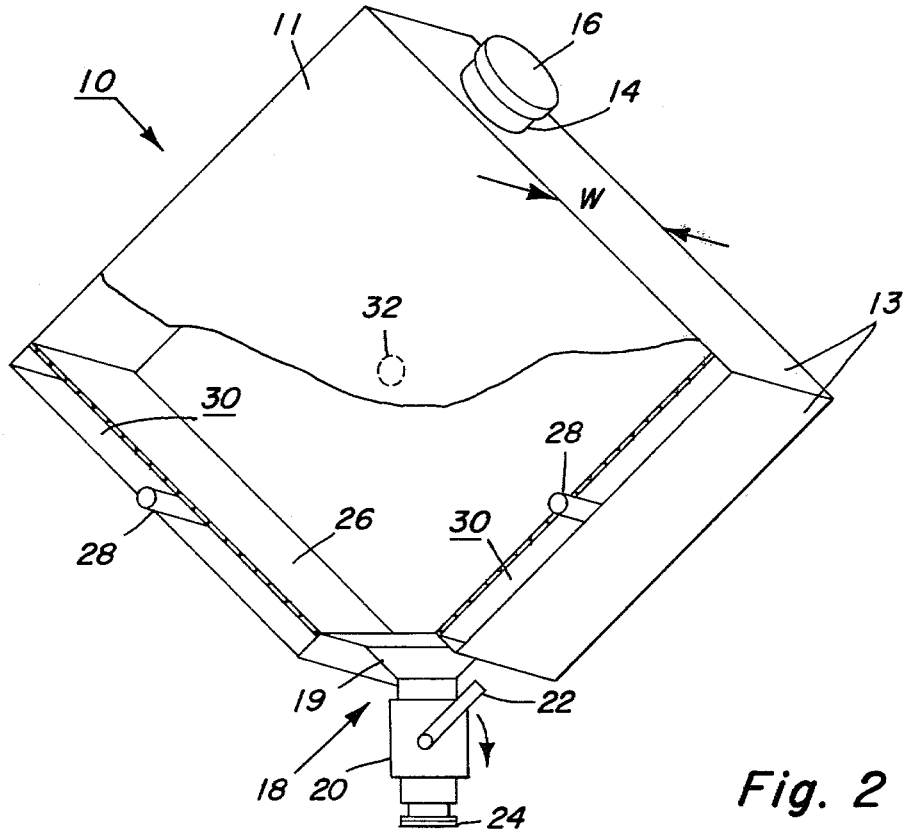
FIG. 2 is a view of the container of FIG. 1 positioned for unloading powders contained therein.

FIG. 1 shows the container 10 in its loading position when cover 16 is removed from pipe 14 so that powder can be loaded in the container. FIG. 2 shows the container 10 in its unloading or discharge position, and in this position, the container is positioned so that the nozzle 24 of valve 20 faces the ground (and the container into which the powder is to be discharged). In this position, valve handle 22 is moved to open valve 20, and gas is fed through inlets 28 into plenums 30 so that any powder that tends to bridge to members 26 in container 10 is moved therefrom and falls to powder discharge port 18.

Any nuclear fuel powder, whether enriched with a fissile material up to about 4% by weight, or not so enriched, can be loaded into container 12 and unloaded therefrom. By way of illustration, various compounds, such as the carbide, oxide and nitride compounds of uranium, plutonium, thorium and mixtures thereof can be loaded into, and unloaded from, container 10. The powders can vary from being very fine (e.g., less than 200 mesh) to being relatively course (e.g., greater than 12 mesh). In one preferred practice, a uranium oxide, such as uranium dioxide enriched with from about 1 to about 4% by weight of the U-235 isotope is loaded into, and unloaded from, container 10 at different locations in a nuclear fuel fabrication facility.

The body 12, inlet 14 and orifice member 19 of container 10 are constructed of steel, such as a stainless steel, and the porous metal, rectangular-plate member is constructed of a laminate of multiple layers of wire mesh bonded together by heating to cause diffusion, so that said laminate has a multiplicity of small openings capable of air flow of approximately 4 standard cubic feet per minute per square foot at 2 inches $H_2O$ pressure differential. Any conventional ball valve can be used for valve 20.

The thickness (labelled "w" in the Figures) is five inches or less when the two large planiform walls of container 10 are 36 inches square, and the container 10 is used with nuclear fuels enriched up to 4% by weight. This provides a container 10 with a critically safe geometric configuration. A preferred container is designed to hold up to about 200 Kg of $UO_2$ powder.

In one embodiment, the inside surface of the container is coated with a nonstick polymeric coating, such as a coating comprised of urethane rubber or a fluorocarbon such as polytetrafluorethylene (Teflon ®).

The critically safe container of this invention can be characterized as a mass flow hopper, i.e., all the particles present in the mass held by the container move simultaneously as the mass held by the container is discharged. This has the advantage of preventing segregation for blended powders stored in the container of this invention when these powders are later discharged for use.

As will be apparent to those skilled in the art, various modifications and changes may be made in the invention described herein. It is accordingly the intention that the invention be construed in the broadest manner within the spirit and scope as set forth in the accompanying claims.

What is claimed is:

1. A method for storing enriched nuclear fuel material in blended powder form in a critically safe container and for discharging said powder from said container without particle size segregation comprising the steps of:

(1) providing a hollow, slab-shaped container body having two large planiform walls and four side walls with one critically safe dimension;

(2) providing a powder inlet on one side wall of said body adjacent a corner thereof;

(3) providing a normally closed powder discharge port at one corner of said body located approximately diagonal to said powder inlet;

(4) providing a pair of gas plenums each formed by attaching a porous metal, rectangular-plate member inside said body slightly spaced from a respective one of the two side walls adjacent said powder discharge port;

(5) providing a gas inlet for feeding gas to each of said plenums;

(6) placing an amount of pre-blended powder through said powder inlet into said container;

(7) opening said powder discharge port while simultaneously providing gas to said gas inlet at a moderate rate of flow which provides about 4 standard cubic feet per minute of gas flow through each square foot of surface of the porous plate members at 2 inches of $H_2O$ pressure differential whereby the gas flow is limited to the region of the porous plate members and said gas flows out of said discharge port with the powder.

* * * * *